US005692666A

United States Patent [19]

Dallas

[11] Patent Number: 5,692,666

[45] Date of Patent: Dec. 2, 1997

[54] ALIGNMENT GUIDE

[75] Inventor: Angelo N. Dallas, Sheboygan, Wis.

[73] Assignee: G. B. Invedyne Inc., Sheboygan, Wis.

[21] Appl. No.: 620,294

[22] Filed: Mar. 22, 1996

Related U.S. Application Data

[63] Continuation-in-part of Ser. No. 243,375, May 16, 1994, abandoned.

[51] Int. Cl.[6] ..... B25C 7/00

[52] U.S. Cl. ..... 227/154; 269/315; 269/303

[58] Field of Search ..... 269/303, 304, 269/315; 83/468.5, 468.6, 468.7; 227/154

[56] References Cited

U.S. PATENT DOCUMENTS

| | | | |
|---|---|---|---|
| 118,419 | 8/1871 | Wood | 83/468.7 |
| 415,637 | 11/1889 | Haueisen et al. | 269/303 |
| 1,245,638 | 11/1917 | Trcka | 269/303 |
| 1,692,779 | 11/1928 | Kline | 269/315 |
| 2,376,460 | 5/1945 | Strandberg | 83/582 |
| 2,589,033 | 3/1952 | Baumgartner | 269/303 |
| 4,186,916 | 2/1980 | Varga | 269/315 |
| 4,286,778 | 9/1981 | Follmeyer | 269/303 |
| 4,317,562 | 3/1982 | Thibodaux | 269/304 |
| 5,390,842 | 2/1995 | Joyce | 227/154 |

FOREIGN PATENT DOCUMENTS

| | | | |
|---|---|---|---|
| 1581636 | 12/1980 | United Kingdom | 269/303 |
| 2225271 | 5/1990 | United Kingdom | 277/154 |

*Primary Examiner*—Rinaldi I. Rada
*Assistant Examiner*—Boyer Ashley
*Attorney, Agent, or Firm*—William Nitkin

[57] ABSTRACT

The device this invention is an alignment device for stapling multiple sheets of paper having a base member with a horizontally disposed stop member, a vertically disposed stop member and an aperture defined in the upper left-hand corner of the base member for receipt of a stapler to be disposed with its anvil under the upper left-hand corners of the sheets to be manually aligned against both stop members for the stapling of the aligned sheets of paper.

3 Claims, 2 Drawing Sheets

ALIGNMENT GUIDE

This application is a continuation-in-part of my previous application entitled Alignment Guide with Stapling Means filed May 16, 1994 Ser. No. 08/243,375, now abandoned.

BACKGROUND OF THE INVENTION

1. Field of the Invention

The device of this invention resides in the area of multiple paper sheet alignment devices and more particularly relates to a device for squaring off multiple sheets for stapling at a corner thereof.

2. Description of the Prior Art

Electrically powered jogging devices which vibrate large numbers of sheets of paper to align them are known in the prior art. After vibration and alignment, such sheets can be taken from such devices and stapled. Such devices, though, are predominantly utilized in commercial settings and the prior art lacks a simple, convenient, non-electric and inexpensive device which can be used in a home or small office setting for the manual alignment of multiple sheets for easy and uniform corner stapling thereof.

SUMMARY OF THE INVENTION

The device of this invention is utilized for the alignment of multiple sheets of paper for corner stapling thereof. It is a goal of this invention to provide an inexpensive and easy-to-use device fo use In the home or small office.

In order to use the device of this invention, the sheets of paper to be edge-aligned are positioned on a sheet placement are of a base member and and manually pushed against a horizontal stop member and a vertical stop member perpendicular thereto, such action causing the sheets to become aligned in a uniform stack. An aperture or slot cut in the base member at its upper left-hand corner allows a stapler having a base corresponding in size to the shape of the aperture or slot to be positioned therein for exact disposition of its anvil member under the aligned upper left-hand corners of the multiple sheets such that when the stapler is manually depressed, or electrically activated if an electric stapler is utilized, the sheets are neatly stapled together.

DESCRIPTION OF THE PREFERRED EMBODIMENT(S)

Figure 1:
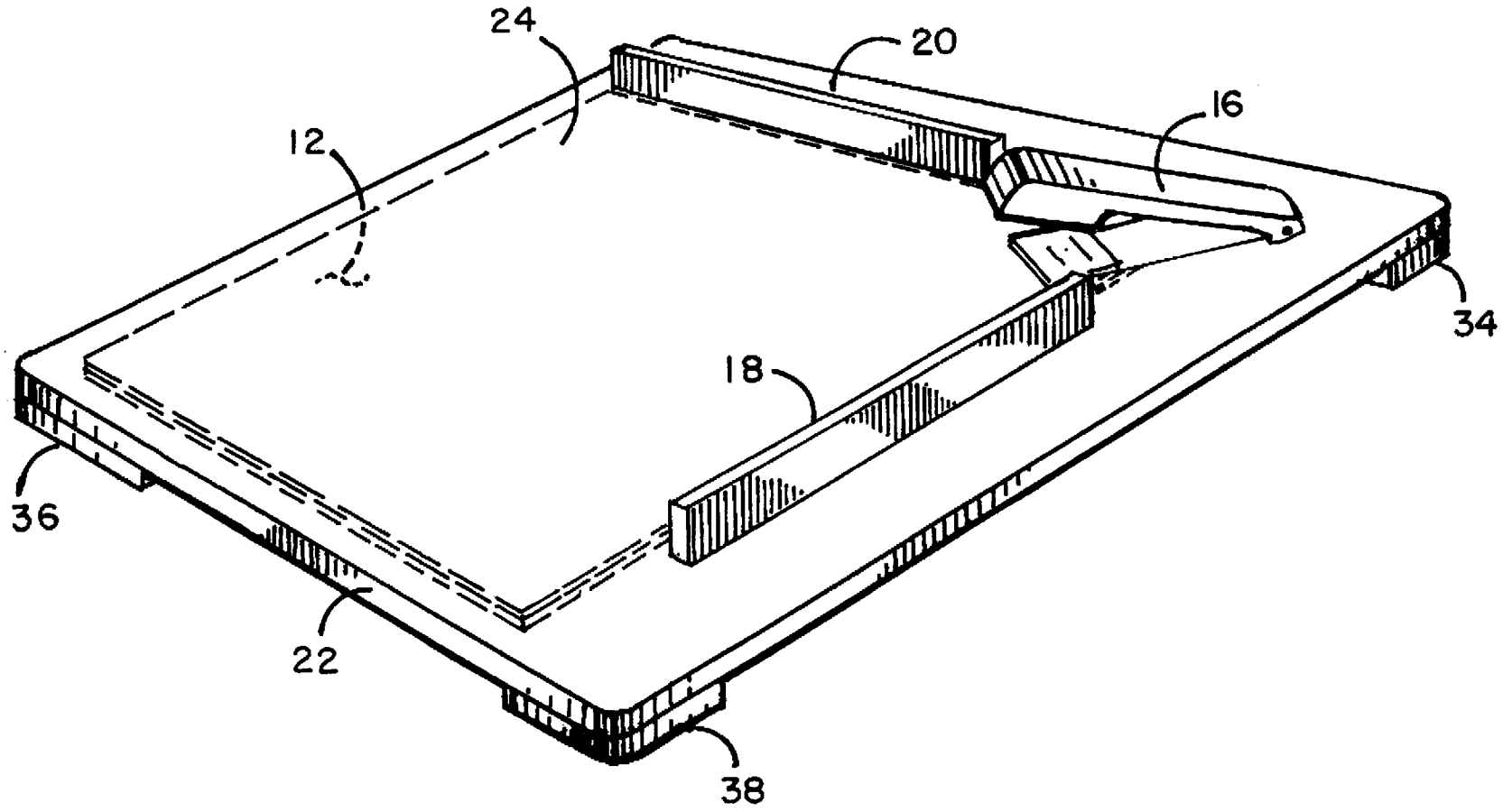
FIG. 1 illustrates a perspective view of the device of this invention with a stapler at the upper left-hand corner thereof.

FIG. 1 illustrates a perspective view of the alignment guide of this invention wherein planar base member 22, as seen, can be generally rectangular in configuration and, in one embodiment, of a size generally larger than the size of the multiple sheets of rectangular paper 24 which are to be placed in sheet placement area 12 of base member 22. Other embodiments can utilize a base member of smaller size than the size of the paper sheets. In one preferred embodiment, base member 22 is approximately ⅛ inch in thickness with legs 34, 36 and 38, with one leg not seen in this view, each being approximately ⅛ inch in height thereunder to position the sheet placement area at the height of the anvil of stapler 16 which stapler is retained within aperture 14 for stapling the upper left-hand corners of the sheets of paper. On the upper top surface of base member 22 is disposed by gluing or equivalent attachment means horizontal stop member 18; and to the left thereof, vertical stop member 20. These stop members are positioned such that the top and left-hand side edges of the multiple sheets when pushed manually against these stop members will easily align them so as to be smoothly and evenly stacked, one above the other. If one extended a line along the length of each stop member, such lines 17 would intersect aperture 14 beyond the anvil of the stapler positioned in such aperture. Since the device of this invention in use would usually be disposed on the flat surface of a desk or table, such position allows the base of the stapler to be positioned in aperture 14 and held in position by the surrounding base member while the sheets are being manually aligned against stop members 18 and 20 and within the mouth opening of the stapler under its head. Stapler 16 is positioned in aperture 14 where it can remain, as mentioned above, with its anvil disposed under the upper left-hand corners of the aligned sheets and disposed at a 45-degree angle to the top and left-hand sides of the sheets which position is desirable for stapling the sheets to allow them to be easily flipped over their upper left-hand corner attachment, when desired. The head of stapler 16, when stapler 16 is in position in aperture 14, can be depressed once sheets 24 have been aligned on base member 22. The device of this invention always places the staples in the same, exact position on each set of multiple sheets to be stapled because the stapler cannot move out of position as it is retained securely by being surrounded by base member 22.

Figures 2, 3:
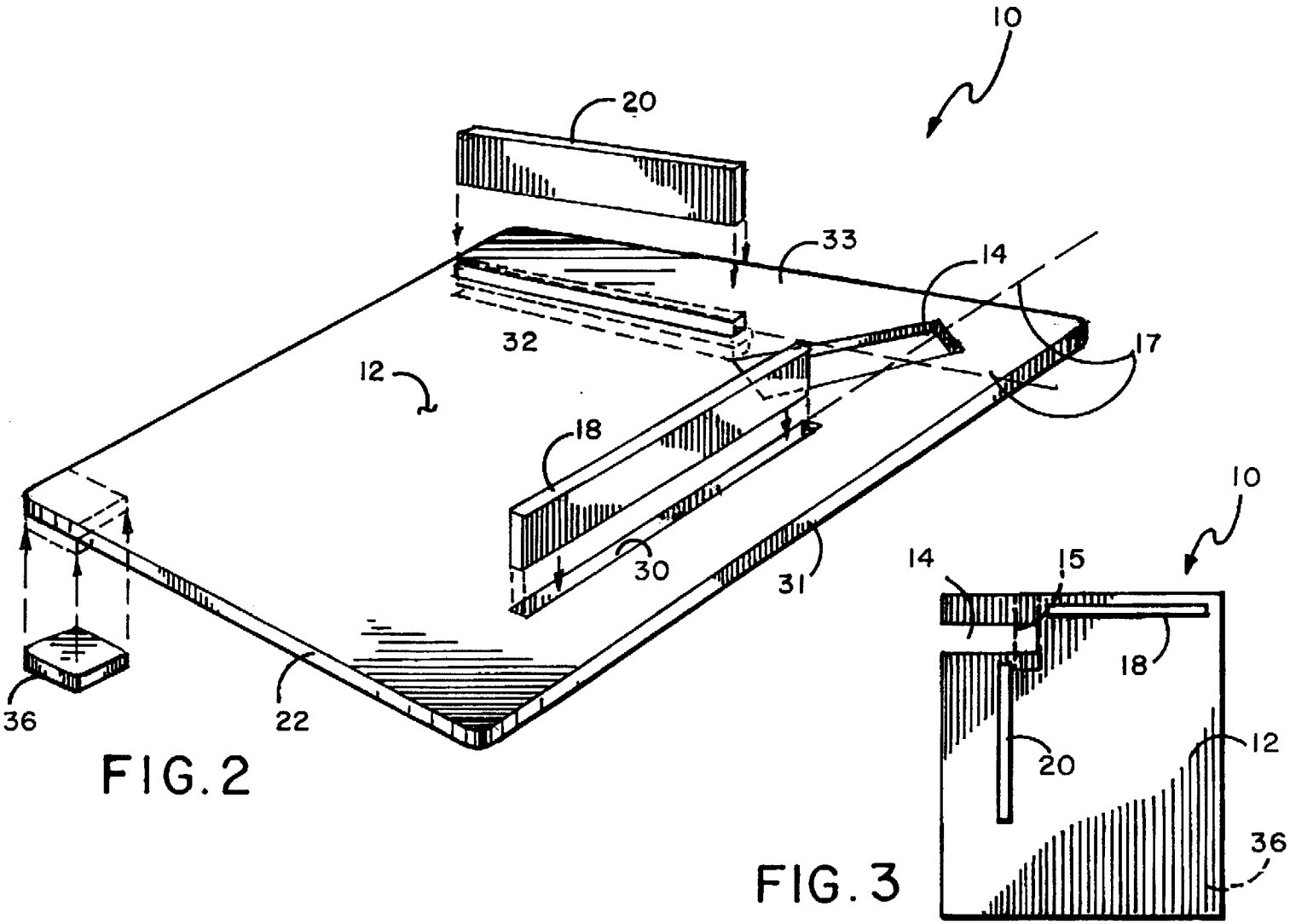
FIG. 2 illustrates a perspective view of the device of FIG. 1 with the components of the stapler alignment guide shown separated.
FIG. 3 illustrates a top view of the device of this invention showing the horizontal and vertical stop members and a laterally disposed slot for receiving the stapler near the upper left-hand corner of the base member.

Seen in FIG. 2 is aperture 14 defined in base member 22 which aperture is disposed at a 45-degree angle to top side 31 and left side 33 of base member 22. In a preferred embodiment stop members 18 and 20 extend upwards from the base member a distance sufficient to be higher than the height of the stack of sheets to be aligned and stapled. Also seen in FIG. 2 are horizontal stop receipt aperture 30 and vertical stop receipt aperture 32 into which elongated openings can be positioned rectangular elements of at least ½ inch in height, forming horizontal stop member 18 and vertical stop member 20 which are positioned downward into their respective receipt apertures and glued in place. They protrude above the upper surface of base member 22 approximately ¼ inch to form their respective stop members. In one embodiment the rectangular elements can be somewhat greater than ½ inch in height and protrude not only above the base member but also below the base member and can act in place of the legs for three corners of the base member, thereby causing the base member to require for stability only a single leg, as seen in FIG. 2 and in dashed lines in FIG. 3, in its second corner opposite its first corner which has the stapler aperture defined therein.

FIG. 3 illustrates an alternate embodiment of the device of this invention wherein aperture 14 is in the form of an open-ended slot into which the stapler can be slid, which slot or aperture is disposed horizontally somewhat below and parallel to horizontal stop member 18. In an alternate embodiment the slot or aperture 15 can be disposed vertically inward of, and parallel to, the vertical stop member as seen by dashed lines 42 in FIG. 3.

Although the present invention has been described with reference to particular embodiments, it will be apparent to those skilled in the art that variations and modifications can be substituted therefor without departing from the principles and spirit of the invention.

I claim:

1. A device for aligning a plurality of rectangular sheets of paper having a size and a corner and stapling said sheets with a stapler having a base and an anvil disposed thereon, comprising:

sheet receiving means including a base member having a planar top surface, a thickness, a first side and a second side forming a first corner therebetween in said base member, a second corner in said base member opposite said first corner, and a sheet placement area having a surface defined on a portion of said base member;

a first stop member having a shape disposed on said planar top surface of said base member and inward from said second side, said first#stop member protruding above said surface of said sheet placement area;

a second stop member having a shape disposed on said base member inward from said first side thereof and offset from said first stop member at approximately a 90-degree angle thereto, said first and second stop members protruding above said surface of said sheet placement area, said first and second stop members allowing said sheets to be manually pushed thereagainst for alignment of said sheets;

stapler receiving means including a stapler receipt aperture defined in said first corner of said base member, said stapler receipt aperture extending diagonally at a 45-degree angle to said first and second sides and inward from said base member's first corner and under said sheet placement area on which said sheets are disposed within an area defined by intersecting lines extended from said first and second stop members, said stapler receipt aperture to receive said base of said stapler and position said anvil to be disposed under the corner of said aligned sheets for stapling thereof, wherein said base member is approximately ⅛ inch in thickness and has a first stop member aperture and a second stop member aperture defined therein in the shape and position, respectively, of said first stop member and second stop member, said first and second stop member apertures for receipt therein, respectively, of said first and second stop member elements, said first and second stop member elements being approximately ½ inch in height and when positioned in their respective apertures are positioned to protrude above said top surface of said base member approximately ¼ inch and to protrude below said base member to act as legs, said device further including at least one leg member being approximately ⅛ inch in height positioned under said second corner of said base member.

2. The device of claim 1 wherein said stapler receipt aperture is a slot having an open end into which said stapler can be slid.

3. A device for aligning a plurality of rectangular sheets of paper having a size and a corner and stapling said sheets with a stapler having a base and an anvil disposed thereon, comprising:

sheet receiving means including a base member having a planar top surface, a thickness, a first side and a second side forming a first corner therebetween in said base member, a second corner in said base member opposite said first corner, and a sheet placement area having a surface defined on a portion of said base member;

a first stop member having a shape disposed on said planar top surface of said base member and inward from said second side, said first#stop member protruding above said surface of said sheet placement area;

a second stop member having a shape disposed on said base member inward from said first side thereof and offset from said first stop member at approximately a 90-degree angle thereto, said first and second stop members protruding above said surface of said sheet placement area, said first and second stop members allowing said sheets to be manually pushed thereagainst for alignment of said sheets;

stapler receiving means including a stapler receipt aperture defined in said base member extending parallel to said base member's first side and under said sheet placement area on which said sheets are disposed within an area defined by intersecting lines extended from said first and second stop members, said stapler receipt aperture to receive said base of said stapler and position said anvil to be disposed under#said aligned sheets for stapling thereof, wherein said base member is approximately ⅛ inch in thickness and has a first stop member aperture and a second stop member aperture defined therein in the shape and position, respectively, of said first stop member and second stop member, said first and second stop member apertures for receipt therein, respectively, of said first and second stop member elements, said first and second stop member elements being approximately ½ inch in height and when positioned in their respective apertures are positioned to protrude above said top surface of said base member approximately ¼ inch and to protrude below said base member to act as legs, said device further including at least one leg member being approximately ⅛ inch in height positioned under said second corner of said base member.

* * * * *